US011261683B2

(12) United States Patent
Kellner et al.

(10) Patent No.: US 11,261,683 B2
(45) Date of Patent: Mar. 1, 2022

(54) DOWNHOLE TOOL WITH SLEEVE AND SLIP

(71) Applicant: INNOVEX DOWNHOLE SOLUTIONS, INC., Houston, TX (US)

(72) Inventors: Justin Kellner, Adkins, TX (US); Nick Tonti, Houston, TX (US); Carl Martin, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/804,765

(22) Filed: Feb. 28, 2020

(65) Prior Publication Data

US 2020/0277831 A1 Sep. 3, 2020

Related U.S. Application Data

(60) Provisional application No. 62/812,508, filed on Mar. 1, 2019, provisional application No. 62/824,165, filed on Mar. 26, 2019.

(51) Int. Cl.
*E21B 23/01* (2006.01)
*E21B 33/129* (2006.01)

(52) U.S. Cl.
CPC ..... *E21B 23/01* (2013.01); *E21B 33/1293* (2013.01)

(58) Field of Classification Search
CPC ... E21B 23/01; E21B 33/1265; E21B 33/1293
See application file for complete search history.

(56) References Cited

U.S. PATENT DOCUMENTS 2,189,697 A 2/1940 Baker
2,222,233 A 11/1940 Mize
2,225,143 A 12/1940 Baker et al.
3,127,198 A 3/1964 Orund
(Continued)

FOREIGN PATENT DOCUMENTS

AR 091776 A1 2/2015
AU 2010214651 A1 3/2012
(Continued)

OTHER PUBLICATIONS

Hinkie et al., "Multizone Completion with Accurately Placed Stimulation Through Casing Wall", SPE Production and Operations Symposium, Mar. 31-Apr. 3, 2007, pp. 1-4.
(Continued)

*Primary Examiner* — Dany E Akakpo
(74) *Attorney, Agent, or Firm* — MH2 Technology Law Group LLP

(57) ABSTRACT

A downhole tool includes a sleeve having a first end and a second end, a slip assembly coupled to the second end of the sleeve, a first cone positioned at least partially in the sleeve, proximal to the first end thereof, and a second cone positioned at least partially in the slip assembly. The first and second cones are configured to be moved toward one another from a run-in configuration to a set configuration. When actuating from the run-in configuration to the set configuration, the sleeve is forced radially outward by the first cone. When actuating from the run-in configuration to the set configuration, the slip assembly is forced radially outward by the second cone.

19 Claims, 11 Drawing Sheets

(56) References Cited

U.S. PATENT DOCUMENTS 3,746,093 A 7/1973 Mullins
3,860,067 A 1/1975 Rodgers
4,155,404 A 5/1979 Hollingsworth
4,483,399 A 11/1984 Colgate
4,901,794 A 2/1990 Baugh et al.
5,064,164 A 11/1991 Le
5,131,468 A 7/1992 Lane et al.
5,325,923 A 7/1994 Surjaatmadja et al.
5,396,957 A 3/1995 Surjaatmadja et al.
5,479,986 A 1/1996 Gano et al.
5,542,473 A 8/1996 Pringle
5,623,993 A 4/1997 Buskirk et al.
5,701,959 A 12/1997 Hushbeck et al.
5,709,269 A 1/1998 Head
5,984,007 A 11/1999 Yuan et al.
6,167,963 B1 1/2001 McMahan et al.
6,220,349 B1 4/2001 Vargus et al.
6,296,054 B1 10/2001 Kunz et al.
6,354,372 B1 3/2002 Carisella et al.
6,354,373 B1 3/2002 Vercaemer et al.
6,446,323 B1 9/2002 Metcalfe et al.
6,581,681 B1 6/2003 Zimmerman et al.
6,662,876 B2 12/2003 Lauritzen
6,684,958 B2 2/2004 Williams et al.
6,695,050 B2 2/2004 Winslow et al.
6,702,029 B2 3/2004 Metcalfe et al.
6,712,153 B2 3/2004 Turley et al.
6,722,437 B2 4/2004 Vercaemer et al.
6,793,022 B2 9/2004 Vick et al.
6,796,376 B2 9/2004 Frazier
6,796,534 B2 9/2004 Beyer et al.
7,048,065 B2 5/2006 Badrak et al.
7,093,656 B2 8/2006 Maguire
7,096,938 B2 8/2006 Carmody et al.
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Abercrombie Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Hailey, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,614,448 B2 11/2009 Swagerty et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
7,980,300 B2 7/2011 Roberts et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,775 B2 3/2015 Spray
8,991,485 B2 3/2015 Chenault et al.
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,228,404 B1 1/2016 Jackson et al.
9,309,733 B2 4/2016 Xu et al.
9,334,702 B2 5/2016 Allen et al.
9,382,790 B2 7/2016 Bertoja et al.
D762,737 S 8/2016 Fitzhugh
D763,324 S 8/2016 Fitzhugh
9,470,060 B2 10/2016 Young
9,574,415 B2 2/2017 Xu et al.
9,605,508 B2 3/2017 Xu et al.
D783,133 S 4/2017 Fitzhugh
9,752,423 B2 9/2017 Lynk
9,835,003 B2 12/2017 Harris
D807,991 S 1/2018 Fitzhugh
9,909,384 B2 3/2018 Chauffe et al.
9,927,058 B2 3/2018 Sue
9,976,379 B2 5/2018 Schmidt
9,976,381 B2 5/2018 Martin et al.
D827,000 S 8/2018 Van Lue
10,156,119 B2 12/2018 Martin et al.
10,400,531 B2 9/2019 Jackson et al.
10,408,012 B2 9/2019 Martin et al.
10,415,336 B2 9/2019 Benzie
10,533,392 B2 1/2020 Walton
10,605,018 B2 3/2020 Schmidt
10,648,275 B2 5/2020 Dirocco
10,920,523 B2 2/2021 Kellner et al.
2003/0062171 A1 4/2003 Maguire et al.
2003/0099506 A1 5/2003 Mosing
2003/0188876 A1 10/2003 Vick et al.
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0189103 A1 9/2005 Roberts et al.
2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.
2006/0272828 A1 12/2006 Manson

(56) References Cited

U.S. PATENT DOCUMENTS

| | | | |
|---|---|---|---|
| 2007/0000664 | A1 | 1/2007 | Ring et al. |
| 2007/0044958 | A1 | 3/2007 | Rytlewski et al. |
| 2007/0272418 | A1 | 11/2007 | Corre et al. |
| 2008/0066923 | A1 | 3/2008 | Xu |
| 2008/0073074 | A1 | 3/2008 | Frazier |
| 2008/0135248 | A1 | 6/2008 | Talley et al. |
| 2008/0135261 | A1 | 6/2008 | McGilvray et al. |
| 2008/0142223 | A1 | 6/2008 | Xu et al. |
| 2008/0190600 | A1 | 8/2008 | Shkurti et al. |
| 2008/0264627 | A1 | 10/2008 | Roberts et al. |
| 2008/0308266 | A1 | 12/2008 | Roberts et al. |
| 2009/0044949 | A1 | 2/2009 | King et al. |
| 2009/0065192 | A1 | 3/2009 | Lucas |
| 2009/0065196 | A1 | 3/2009 | Holland et al. |
| 2009/0205843 | A1 | 8/2009 | Gandikota et al. |
| 2009/0242213 | A1 | 10/2009 | Braddick |
| 2009/0266560 | A1 | 10/2009 | Ring et al. |
| 2010/0032167 | A1 | 2/2010 | Adam et al. |
| 2010/0038072 | A1 | 2/2010 | Akselberg |
| 2010/0116489 | A1 | 5/2010 | Nelson |
| 2010/0132960 | A1 | 6/2010 | Shkurti et al. |
| 2010/0170682 | A1 | 7/2010 | Brennan, III et al. |
| 2010/0263857 | A1 | 10/2010 | Frazier |
| 2010/0270031 | A1 | 10/2010 | Patel |
| 2010/0270035 | A1 | 10/2010 | Ring et al. |
| 2010/0276159 | A1 | 11/2010 | Mailand et al. |
| 2010/0314127 | A1 | 12/2010 | Swor et al. |
| 2010/0319427 | A1 | 12/2010 | Lohbeck |
| 2010/0319927 | A1 | 12/2010 | Yokley et al. |
| 2011/0005779 | A1 | 1/2011 | Lembcke |
| 2011/0048743 | A1 | 3/2011 | Stafford et al. |
| 2011/0088891 | A1 | 4/2011 | Stout |
| 2011/0132143 | A1 | 6/2011 | Xu et al. |
| 2011/0132619 | A1 | 6/2011 | Agrawal et al. |
| 2011/0132621 | A1 | 6/2011 | Agrawal et al. |
| 2011/0132623 | A1 | 6/2011 | Moeller |
| 2011/0232899 | A1 | 9/2011 | Porter |
| 2011/0240295 | A1 | 10/2011 | Porter et al. |
| 2011/0266004 | A1 | 11/2011 | Hallundbaek et al. |
| 2011/0284232 | A1 | 11/2011 | Huang |
| 2012/0024109 | A1 | 2/2012 | Xu et al. |
| 2012/0055669 | A1 | 3/2012 | Levin et al. |
| 2012/0067583 | A1 | 3/2012 | Zimmerman et al. |
| 2012/0097384 | A1 | 4/2012 | Valencia |
| 2012/0111566 | A1 | 5/2012 | Sherman et al. |
| 2012/0118583 | A1 | 5/2012 | Johnson et al. |
| 2012/0132426 | A1 | 5/2012 | Xu et al. |
| 2012/0168163 | A1 | 7/2012 | Bertoja et al. |
| 2012/0199341 | A1 | 8/2012 | Kellner et al. |
| 2012/0205873 | A1 | 8/2012 | Turley |
| 2012/0247767 | A1 | 10/2012 | Themig et al. |
| 2012/0273199 | A1 | 11/2012 | Cresswell et al. |
| 2013/0008671 | A1 | 1/2013 | Booth |
| 2013/0062063 | A1 | 3/2013 | Baihly et al. |
| 2013/0081825 | A1 | 4/2013 | Lynde et al. |
| 2013/0186615 | A1 | 7/2013 | Hallubaek et al. |
| 2013/0186616 | A1 | 7/2013 | Xu et al. |
| 2013/0192853 | A1 | 8/2013 | Themig |
| 2013/0299185 | A1 | 11/2013 | Xu et al. |
| 2014/0014339 | A1 | 1/2014 | O'Malley et al. |
| 2014/0076571 | A1 | 3/2014 | Frazier et al. |
| 2014/0131054 | A1 | 5/2014 | Raynal |
| 2014/0209325 | A1 | 7/2014 | Dockweiler |
| 2014/0224477 | A1 | 8/2014 | Wiese |
| 2014/0238700 | A1 | 8/2014 | Williamson |
| 2014/0262214 | A1 | 9/2014 | Mhaskar |
| 2014/0352970 | A1 | 12/2014 | Kristoffer |
| 2015/0027737 | A1 | 1/2015 | Rochen |
| 2015/0068757 | A1 | 3/2015 | Hofman et al. |
| 2015/0075774 | A1 | 3/2015 | Raggio |
| 2015/0129215 | A1 | 5/2015 | Xu et al. |
| 2015/0184485 | A1 | 7/2015 | Xu et al. |
| 2015/0218904 | A1 | 8/2015 | Chauffe et al. |
| 2016/0160591 | A1 | 6/2016 | Xu et al. |
| 2016/0186511 | A1* | 6/2016 | Coronado ..... E21B 33/129 166/381 |
| 2016/0290096 | A1 | 10/2016 | Tse |
| 2016/0305215 | A1 | 10/2016 | Harris et al. |
| 2016/0312557 | A1 | 10/2016 | Kitzman |
| 2016/0333655 | A1 | 11/2016 | Fripp |
| 2016/0376869 | A1* | 12/2016 | Rochen ..... E21B 29/02 166/135 |
| 2017/0022781 | A1 | 1/2017 | Martin |
| 2017/0067328 | A1 | 3/2017 | Chauffe |
| 2017/0101843 | A1 | 4/2017 | Waterhouse et al. |
| 2017/0130553 | A1 | 5/2017 | Harris et al. |
| 2017/0146177 | A1* | 5/2017 | Sue ..... F16L 55/132 |
| 2017/0218711 | A1 | 8/2017 | Kash |
| 2017/0260824 | A1 | 9/2017 | Kellner |
| 2017/0370176 | A1* | 12/2017 | Frazier ..... E21B 33/1291 |
| 2018/0030807 | A1 | 2/2018 | Martin |
| 2018/0073325 | A1 | 3/2018 | Dolog |
| 2018/0087345 | A1* | 3/2018 | Xu ..... E21B 23/06 |
| 2018/0266205 | A1 | 9/2018 | Martin |
| 2018/0363409 | A1 | 12/2018 | Frazier |
| 2019/0063179 | A1* | 2/2019 | Murphy ..... E21B 23/01 |
| 2019/0106961 | A1 | 4/2019 | Hardesty |
| 2019/0203556 | A1 | 7/2019 | Powers |
| 2019/0264513 | A1 | 8/2019 | Kosel |
| 2019/0292874 | A1 | 9/2019 | Saeed |
| 2020/0072019 | A1 | 3/2020 | Tonti |
| 2020/0131882 | A1 | 4/2020 | Tonti |
| 2020/0173246 | A1 | 6/2020 | Kellner |
| 2020/0248521 | A1 | 8/2020 | Southard |
| 2020/0256150 | A1 | 8/2020 | Kellner |

FOREIGN PATENT DOCUMENTS

| | | | |
|---|---|---|---|
| EP | 2251525 | A1 | 11/2010 |
| GB | 2345308 | A | 7/2000 |
| GB | 2448449 | A | 10/2008 |
| GB | 2448449 | B | 12/2008 |
| GB | 2482078 | A | 1/2012 |
| WO | 2010039131 | A1 | 4/2010 |
| WO | 2011/023743 | A2 | 11/2011 |
| WO | 2011/137112 | A2 | 11/2011 |
| WO | 2014/014591 | A1 | 1/2014 |
| WO | 2014/100072 | A1 | 6/2014 |
| WO | 2016/160003 | A1 | 10/2016 |
| WO | 2017/151384 | A1 | 9/2017 |

OTHER PUBLICATIONS

Anjum et al., "Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way", SPE International Oil & Gas Conference, Jun. 8-10, 2010, pp. 1-16.

Vargus et al., "Completion System allows for Interventionless Stimulation Treatments in Horizontal Wells with Multiple Shale Pay Zones", SPE Annual Technical Conference, Sep. 2008, pp. 1-8.

Gorra et al., "Expandable Zonal Isolation Barrier (ZIB) Provides a Long-Term Well Solution as a High Differential Pressure Metal Barrier to Flow", Brazilian Petroleum Technical Papers, 2010, Abstract only, 1 page.

Vargus, et al., "System Enables Multizone Completions", The American Oil & Gas Reporter, 2009, Abstract only, 1 page.

Vargus et al., "Completion System Allows for Interventionless Stimulation Treatments in Horizontal Wells with Multiple Shale Pay Zones", Annual SPE Technical Conference, Sep. 2008, Abstract only, 1 page.

Zhang et al., High Strength Nanostructured Materials and Their Oil Field Applications, SPE 157092, SPE International, 2012, pp. 1-6.

Xu et al., Smart Nanostructured Materials Deliver High Reliability Completion Tools for Gas Shale Fracturing, SPE 146586, SPE International, 2011, pp. 1-6.

Larimore et al., Overcoming Completion Challenges with Interventionless Devices—Case Study—The "Disappearing Plug", SPE 63111, SPE International, 2000, pp. 1-13.

(56) References Cited

OTHER PUBLICATIONS

King et al., A Methodology for Selecting Interventionless Packer Setting Techniques, SPE-90678-MS, Society of Petroleum Engineers, 2004, pp. 1-3.
Non-Final Office Action dated May 12, 2021, U.S. Appl. No. 16/818,502, 7 pages.
Chakraborty et al., Drilling and Completions Services and Capabilities Presentation, Jan. 2018, Virtual Integrated Analytic Solutions, Inc., 33 pages.
World Oil, Slotted Liner Design for SAGD Wells ///, Jun. 2007, WorldOil.Com, https://www.worldoil.com/magazine/2007/june-2007/special-focus/slotted-liner-design-for-sagd-wells, 1 page.

* cited by examiner

DOWNHOLE TOOL WITH SLEEVE AND SLIP

CROSS-REFERENCE TO RELATED APPLICATIONS

This application claims priority to U.S. Provisional Patent Application having Ser. No. 62/812,508, which was filed on Mar. 1, 2019. This application also claims priority to U.S. Provisional Patent Application having Ser. No. 62/824,165, which was filed on Mar. 26, 2019. Each of these priority applications is incorporated by reference in its entirety.

BACKGROUND

There are various methods by which openings are created in a production liner for injecting fluid into a formation. In a "plug and perf" frac job, the production liner is made up from standard lengths of casing. Initially, the liner does not have any openings through its sidewalls. The liner is installed in the wellbore, either in an open bore using packers or by cementing the liner in place, and the liner walls are then perforated. The perforations are typically created by perforation guns that discharge shaped charges through the liner and, if present, adjacent cement.

The production liner is typically perforated first in a zone near the bottom of the well. Fluids then are pumped into the well to fracture the formation in the vicinity of the perforations. After the initial zone is fractured, a plug is installed in the liner at a position above the fractured zone to isolate the lower portion of the liner. The liner is then perforated above the plug in a second zone, and the second zone is fractured. This process is repeated until all zones in the well are fractured.

The plug and perf method is widely practiced, but it has a number of drawbacks, including that it can be extremely time consuming. The perforation guns and plugs are generally run into the well and operated individually. After the frac job is complete, the plugs are removed (e.g., drilled out) to allow production of hydrocarbons through the liner.

SUMMARY

Embodiments of the disclosure may provide a downhole tool including a sleeve having a first end and a second end, a slip assembly coupled to the second end of the sleeve, a first cone positioned at least partially in the sleeve, proximal to the first end thereof, and a second cone positioned at least partially in the slip assembly. The first and second cones are configured to be moved toward one another from a run-in configuration to a set configuration. When actuating from the run-in configuration to the set configuration, the sleeve is forced radially outward by the first cone, and when actuating from the run-in configuration to the set configuration, the slip assembly is forced radially outward by the second cone.

Embodiments of the disclosure may also provide a downhole assembly including a downhole tool that includes a sleeve having a first end and a second end, a slip assembly coupled to the second end of the sleeve, a first cone positioned at least partially in the sleeve, proximal to the first end thereof, the first cone defining a valve seat, and a second cone positioned at least partially in the slip assembly. The first and second cones are configured to be moved toward one another from a run-in configuration to a set configuration. When actuating from the run-in configuration to the set configuration, the sleeve is forced radially outward by the first cone. When actuating from the run-in configuration to the set configuration, the slip assembly is forced radially outward by the second cone. The assembly also includes a setting tool including a setting sleeve configured to apply a force on the first cone, to move the first cone toward the second cone, and a setting rod extending in the setting sleeve, through the first cone, and releasably coupled with the second cone, the setting rod being configured to apply a force on the second cone to move the second cone toward the first cone. The assembly further includes an obstructing member configured to engage the valve seat of the first cone, so as to block fluid flow through the downhole tool, when the downhole tool is in the set configuration.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
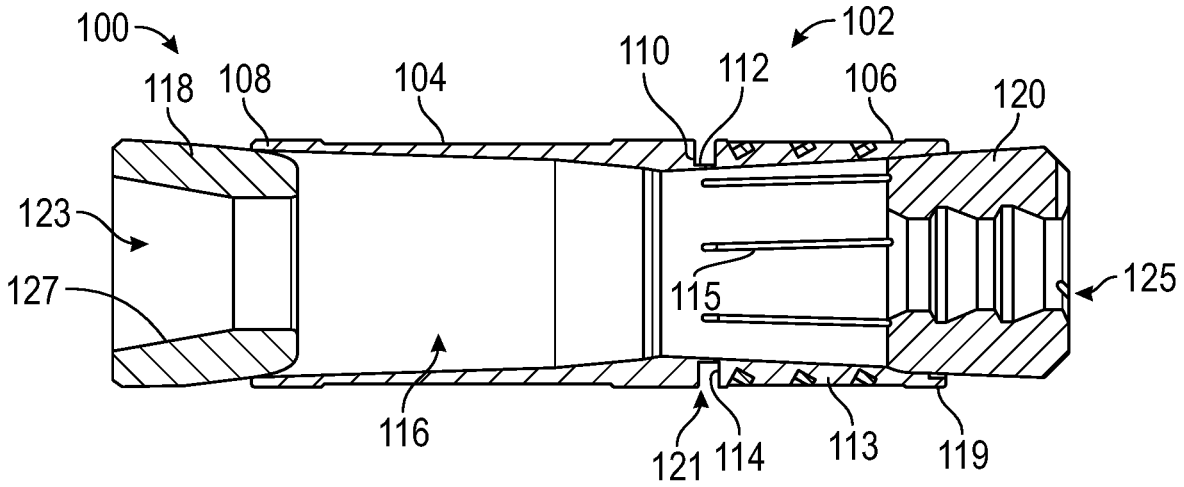
FIG. 1 illustrates a side, cross-sectional view of a downhole tool in a run-in configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, cross-sectional view of a downhole tool 100 in a run-in configuration, according to an embodiment. The downhole tool 100 may, in some embodiments, be a frac plug, or frac diverter, but in other embodiments, may be other types of plugs or other downhole tools. The illustrated downhole tool 100 may include a main body 102, which may include a sleeve 104 and a slip assembly 106. In an embodiment, the main body 102 may be integrally formed, e.g., by cutting and/or otherwise forming the contours thereof from a single tubular. In another embodiment, the main body 102 may be formed from two or more structures that are coupled together.

The sleeve 104 may include a first or "upper" end 108 and a second or "lower" end 110. The slip assembly 106 may be coupled to the sleeve 104, proximal to the second end 110. For example, a connection member 112 may extend between and couple together the second end 110 of the sleeve 104 with an axial surface 114 of the slip assembly 106. The connection member 112 may have a reduced thickness as compared to the sleeve 104 and the slip assembly 106, and may thus define a gap 121 between the axial surface 114 and the second end 110. Further, the connection member 112, having the reduced thickness, may provide a preferential location for the slip assembly 106 to break away from the sleeve 104, as will be described in greater detail below.

The sleeve 104, the slip assembly 106, and the connection member 112 may, in some embodiments, be integral to one another, or may be formed from two or more separate pieces that are connected together. Either such example is within the scope of the term "coupled to" as it relates to the sleeve 104, the slip assembly 106, and/or the connection member 112.

The slip assembly 106 may include a plurality of slip segments 113, which may be positioned circumferentially adjacent to one another. For example, a plurality of axial slots 115 may be formed circumferentially between the slip segments 113. In some embodiments, the slots 115 may not extend across the entire axial extent of the slip assembly 106, and thus bridge portions 117 (FIG. 2) may connect together the circumferentially adjacent slip segments 113 of the slip assembly 106, e.g., proximal to a lower end 119 thereof.

Further, in an embodiment, the sleeve 104, the slip assembly 106, and the connection member 112 may together form a bore 116 extending axially through the entirety of the main body 102. In other embodiments, the bore 116 may extend partially through the main body 102 and/or may be at least partially defined by other structures.

A first or "upper" cone 118 and a second or "lower" cone 120 may be positioned at least partially in the bore 116. The first cone 118 may initially be positioned partially within the sleeve 104, proximal to the first end 108 thereof. The second cone 120 may initially be positioned at least partially within the slip assembly 106, e.g., proximal to the lower end 119 thereof. The cones 118, 120 may be configured to radially expand a section of the sleeve 104 and the slip assembly 106, respectively, when moved toward one another (e.g., adducted together). The cones 118, 120 may be adducted together via a setting tool, pressure within the wellbore above the downhole tool 100, or both.

The first and second cones 118, 120 may be annular, with each providing a through-bore 123, 125 extending axially therethrough, which communicates with the bore 116. The first cone 118 may additionally include a valve seat 127 in communication with the through-bore 123, which may be configured to receive an obstructing member (e.g., a ball, dart, etc.), and thus seal the bore 116. The through-bore 125 of the second cone 120 may be configured to engage the setting tool, such that the second cone 120 may be forced upwards, towards the first cone 118, as will be described below.

In some embodiments, the sleeve 104, at least a portion of the slip assembly 106, the connection member 112, and the cones 118, 120 may be formed from a dissolvable material, such as magnesium, that is configured to dissolve in the wellbore after a certain amount of time, in the presence of certain chemicals, or the like.

Figure 2:
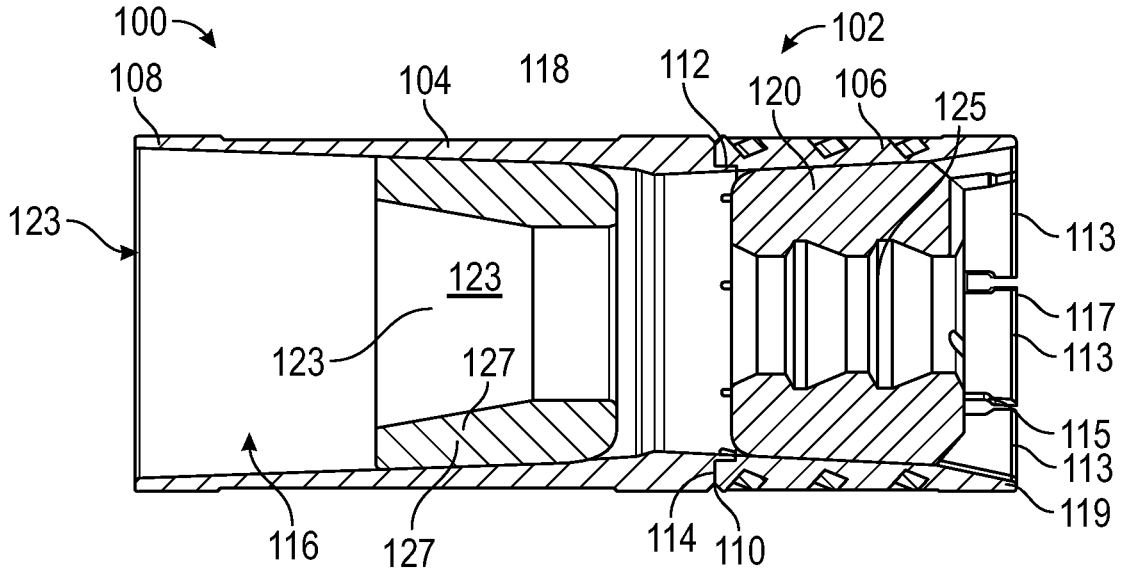
FIG. 2 illustrates a side, cross-sectional view of the downhole tool in a set configuration, according to an embodiment.

FIG. 2 illustrates a side, cross-sectional view of the downhole tool 100 in a set configuration, according to an embodiment. In this configuration, the downhole tool 100 may be configured to anchor to and seal within a surrounding tubular (e.g., a liner, a casing, or the wellbore wall). To actuate the downhole tool 100 from the run-in configuration of FIG. 1 to the set configuration of FIG. 2, the first and second cones 118, 120 are adducted toward one another, as mentioned above. This adduction moves the first and second cones 118, 120 each further into the main body 102, causing the first and second cones 118, 120 to progressively radially expand a section of the sleeve 104 and the slip assembly 106, respectively. In another embodiment, as explained in greater detail below, the sleeve 104 may not be expanded, but rather unwound or otherwise driven outwards into sealing engagement with the surrounding tubular.

In the embodiment of FIGS. 1 and 2, however, as the first cone 118 advances in the bore 116, an outer surface thereof may force a section of the sleeve 104 outwards, in a generally constant radial orientation around the circumference of the sleeve 104. As such, the sleeve 104 may reduce in thickness and/or axial length, may be squeezed between the first cone 118 and the surrounding tubular, and may form at least a partial seal therewith.

In contrast, when the second cone 120 advances in the bore 116, the second cone 120 may break the slip segments 113 apart, e.g., at the bridge portions 117 thereof. As the second cone 120 continues into the bore 116, the connection member 112 may also yield or shear, thereby releasing the slip segments 113 not only from connection with one another, but also with connection with the sleeve 104. The wedge action of the second cone 120 may thus continue forcing the slip segments 113 radially outward, as well as axially toward the second end 110 of the sleeve 104. At some point, the axial surface 114 of the slip assembly 106 (e.g., of the individual slip segments 113) may engage the second end 110, as shown, thereby closing or substantially closing the gap 121. Further, the slip assembly 106 may be pushed radially outward and axially over the remaining connection member 112, as shown.

Prior to breaking from the connection member 112, the slip assembly 106 may thus be pivoted outwards, and towards the sleeve 104. This is in contrast to the expansion of conventional slip assemblies, which are driven up a centrally-positioned cone, which thus causes the slip assembly to pivot away from the sealing members of the tool.

Further, the outward expansion of the slip assembly 106, e.g., by breaking the slip segments 113 apart from one another, may result in the slip segments 113 anchoring into the surrounding tubular. This may occur before, after, or at the same time that the sleeve 104 forms at least a partial seal with the surrounding tubular. As such, a two-part anchoring, provided by the sleeve 104 and the slip assembly 106, is provided. In some situations, sand may interfere with the holding force reachable by the anchoring of the surface of the sleeve 104 with the surrounding tubular. In such situations, the holding force offered by the slip assembly 106, which may be less prone to interference by sand, may serve to hold the downhole tool 100 in position relative to the surrounding tubular.

Figure 3:
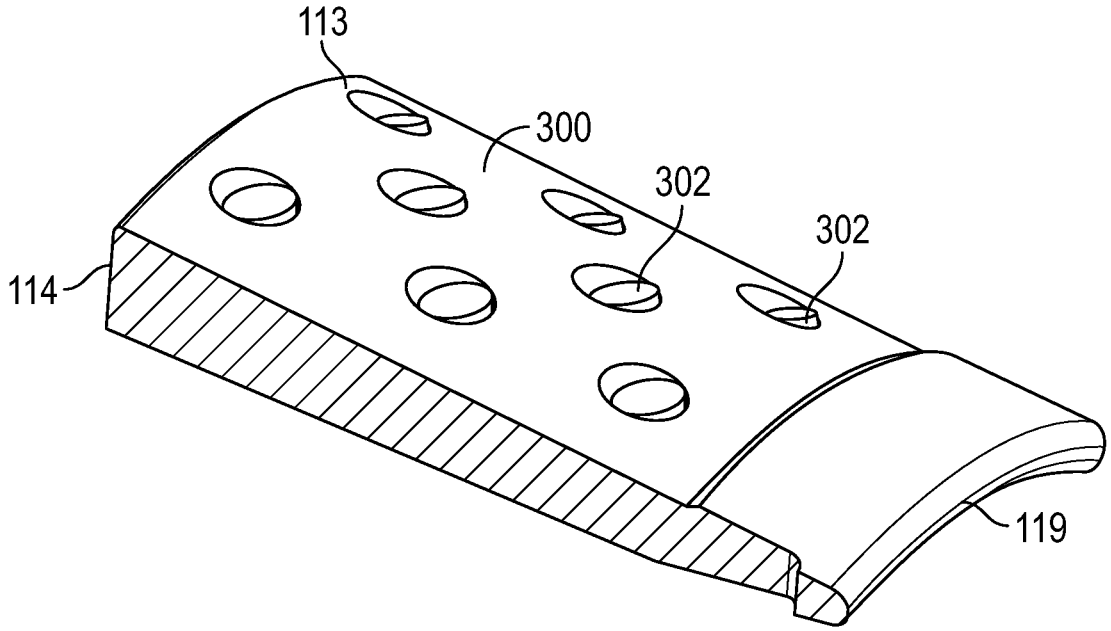
FIG. 3 illustrates a perspective view of a slip segment of the downhole tool, according to an embodiment.

FIG. 3 illustrates a perspective view of one slip segment 113, according to an embodiment. As shown, the slip segment 113 may include a thickness (e.g., in the radial direction, referring to FIGS. 1 and 2) that increases as proceeding toward the axial surface 114, e.g., away from the lower end 119. Further, the slip segment 113 may include engaging structures on an outer surface 300 of the slip segment 113. In the illustrated embodiment, the engaging structures include a plurality of buttons or inserts 302, which may be at least partially embedded into the slip segment 113. The inserts 302 may be formed from a suitably hard material, such that the inserts 302 are capable of being pressed into the surrounding tubular, which may be made from steel. Accordingly, the inserts 302 may be made from a carbide or ceramic material. In some embodiments, the engaging structure may include a grit coating, such as WEARSOX®, which is commercially-available from Innovex Downhole Solutions, Inc., may be applied to the outer surface 300, and may provide increased holding forces. In some embodiments, the engaging structure may include both the inserts 302 and the grit coating, or any other suitable material.

Figure 4:
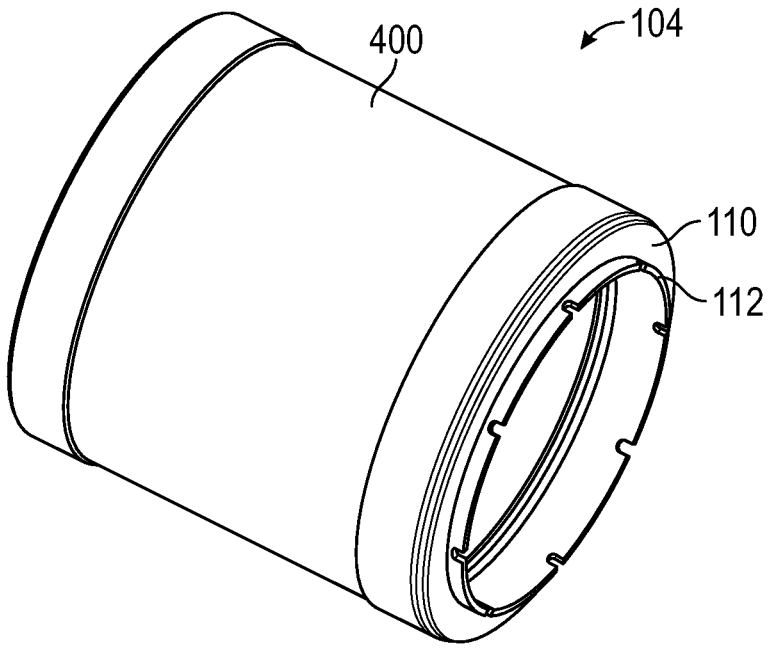
FIG. 4 illustrates a side, cross-sectional view of a sleeve portion of the downhole tool, according to an embodiment.
Figure 5:
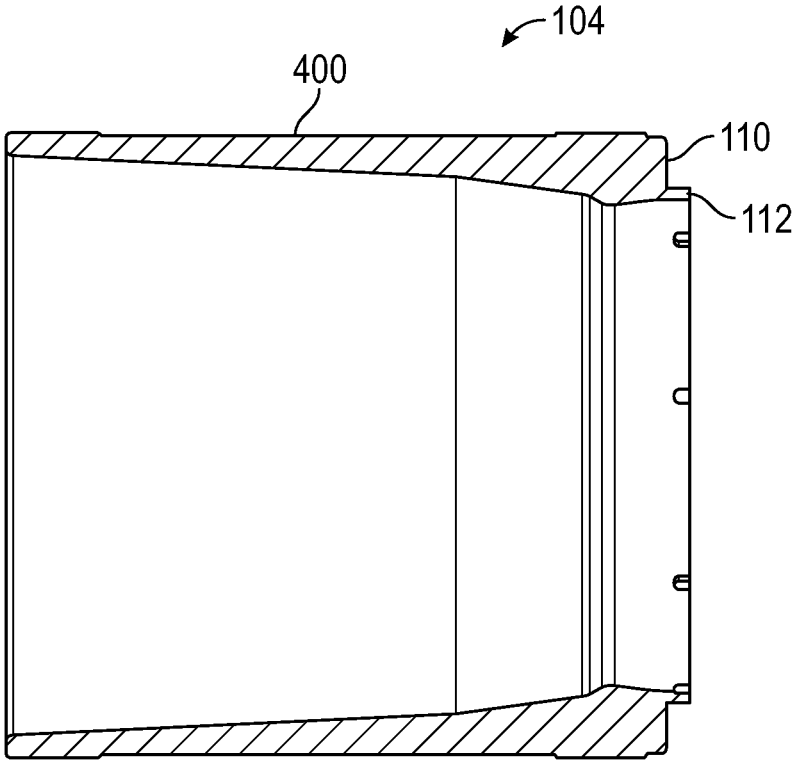
FIG. 5 illustrates a perspective view of the sleeve portion of the downhole tool, according to an embodiment.

FIG. 4 illustrates a perspective view of the sleeve 104 and the connection member 112, according to an embodiment. FIG. 5 illustrates a side, cross-sectional view of the sleeve 104 and the connection member 112, according to an embodiment. The views of FIGS. 4 and 5 may represent the sleeve 104 and the connection member 112 after the connection member 112 has yielded and the slip assembly 106 has been released therefrom. The sleeve 104 may include a continuous outer diameter surface 400. Ideally, when expanded, a section of the outer diameter surface 400 is pressed into engagement with the surrounding tubular, thereby forming a metal-metal seal therewith. In practice, however, as mentioned above, sand, irregularities of the surrounding tubular, or other conditions may interfere with a complete engagement therebetween. Thus, while at least a partial seal may be maintained between the sleeve 104 and the surrounding tubular, the slip assembly 106 may provide additional holding force to maintain a stationary position of the downhole tool 100 within the surrounding tubular.

Additionally, the connection member 112 is shown extending from the second end 110 of the sleeve 104. The connection member 112 may be an area of reduced radial thickness, as is visible in FIGS. 4 and 5. For example, the connection member 112 may have an inner diameter that is generally the same as the inner diameter of the sleeve 104 at its second end 110. The outer diameter of the connection member 112 is thus smaller than the outer diameter surface 400 of the sleeve 104, resulting in the gap 121 mentioned above and illustrated in FIGS. 1 and 2.

Figure 6:
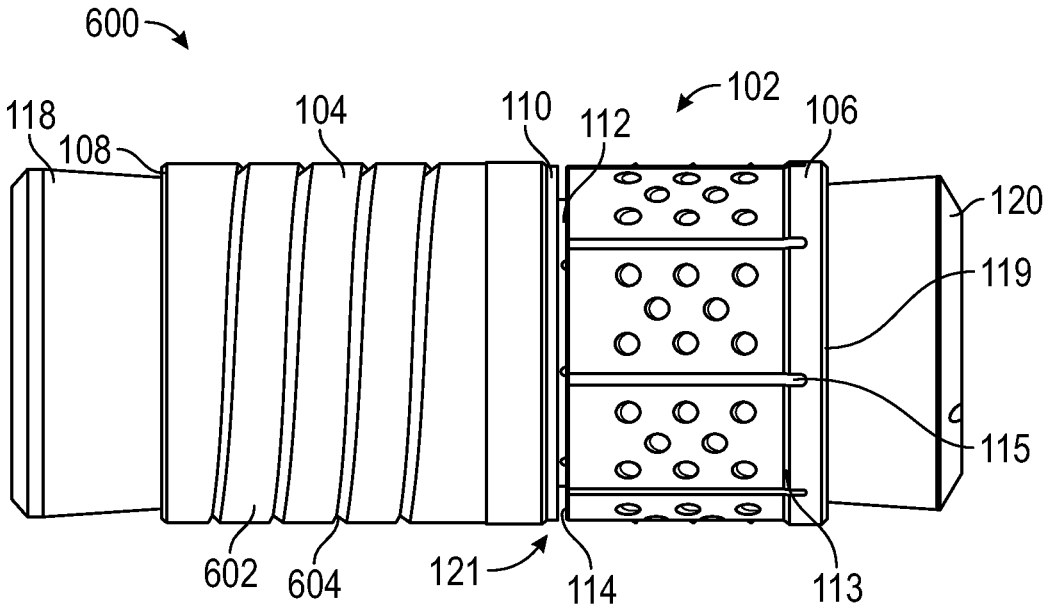
FIG. 6 illustrates a side view of another downhole tool including an alternate sleeve portion and a slip assembly, according to an embodiment.
Figure 7:
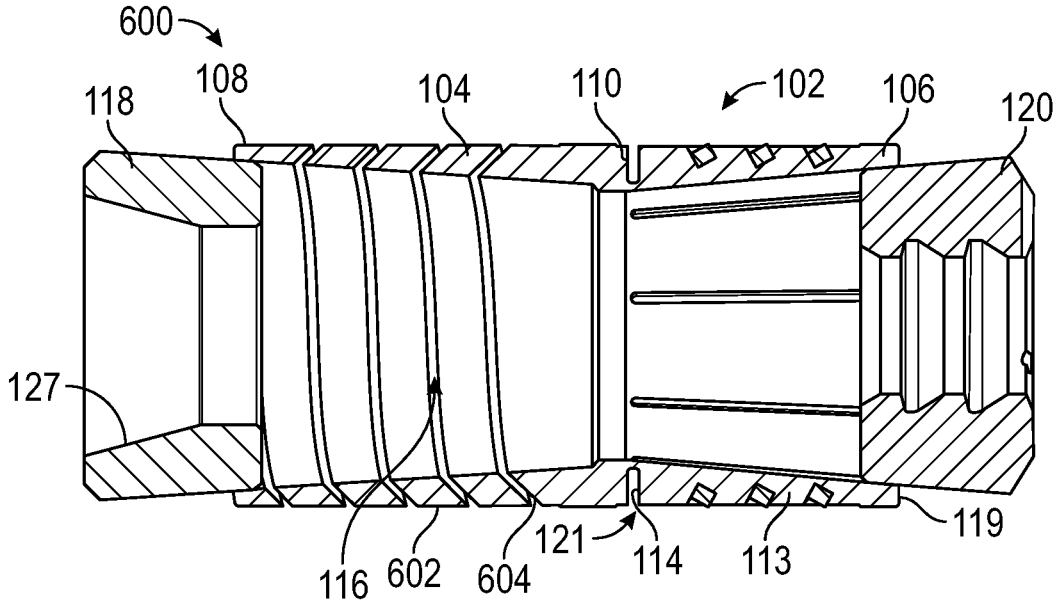
FIG. 7 illustrates a side, cross-sectional view of the downhole tool of FIG. 6, according to an embodiment.

FIGS. 6 and 7 illustrates a side view, and a side, cross-sectional view, respectively, of another downhole tool 600, according to an embodiment. The downhole tool 600 may be generally similar to the downhole tool 100 discussed above and shown in FIG. 1-5; however, rather than the sleeve 104 having a continuous outer surface, the sleeve 104 may provide a helical seal body 602. The seal body 602 may include one or more grooves 604 cut at least partially, radially therein. The groove 604 may be cut some angle off of the axis of body 602 approximating, but not limited to 30°-45°. The groove 604 may extend helically around the seal body 602 along some, a majority of, or substantially all of the axial length between an upper end 108, to a lower end 110 thereof that connects to the connection member 112 and then to the slip assembly 106.

In operation, the upper and lower cones 118, 120 are forced together to actuate the downhole tool 600 from the run-in configuration to the set configuration. As this occurs, the upper cone 118 progresses into the seal body 602. In turn, the upper cone 118 breaks any remaining area of the seal body 602 in the groove 604. In some embodiments, as mentioned above, the groove 604 may extend all the way radially through the seal body 602 and thus potentially nothing in the seal body 602 may be broken during setting. Whether breaking a remaining portion or not, the advancement of the upper cone 118 into the seal body 602 expands the seal body 602 by "unwinding" the helical seal body 602. That is, the upper end 108 of the expandable sleeve 104, and thus the seal body 602, may shift circumferentially (rotate about a central longitudinal axis of the sleeve 104), thereby reducing the axial length of the seal body 602, and increasing the outer diameter thereof. This may continue until the seal body 602 engages the surrounding tubular such that a predetermined setting force is achieved. Further setting may be achieved using pressure and a ball or other obstructing member received into the valve seat 127 of the upper cone 118, which forces the upper cone 118 further into the seal body 602 (e.g., toward the right, as shown in FIGS. 6 and 7).

Figure 8:
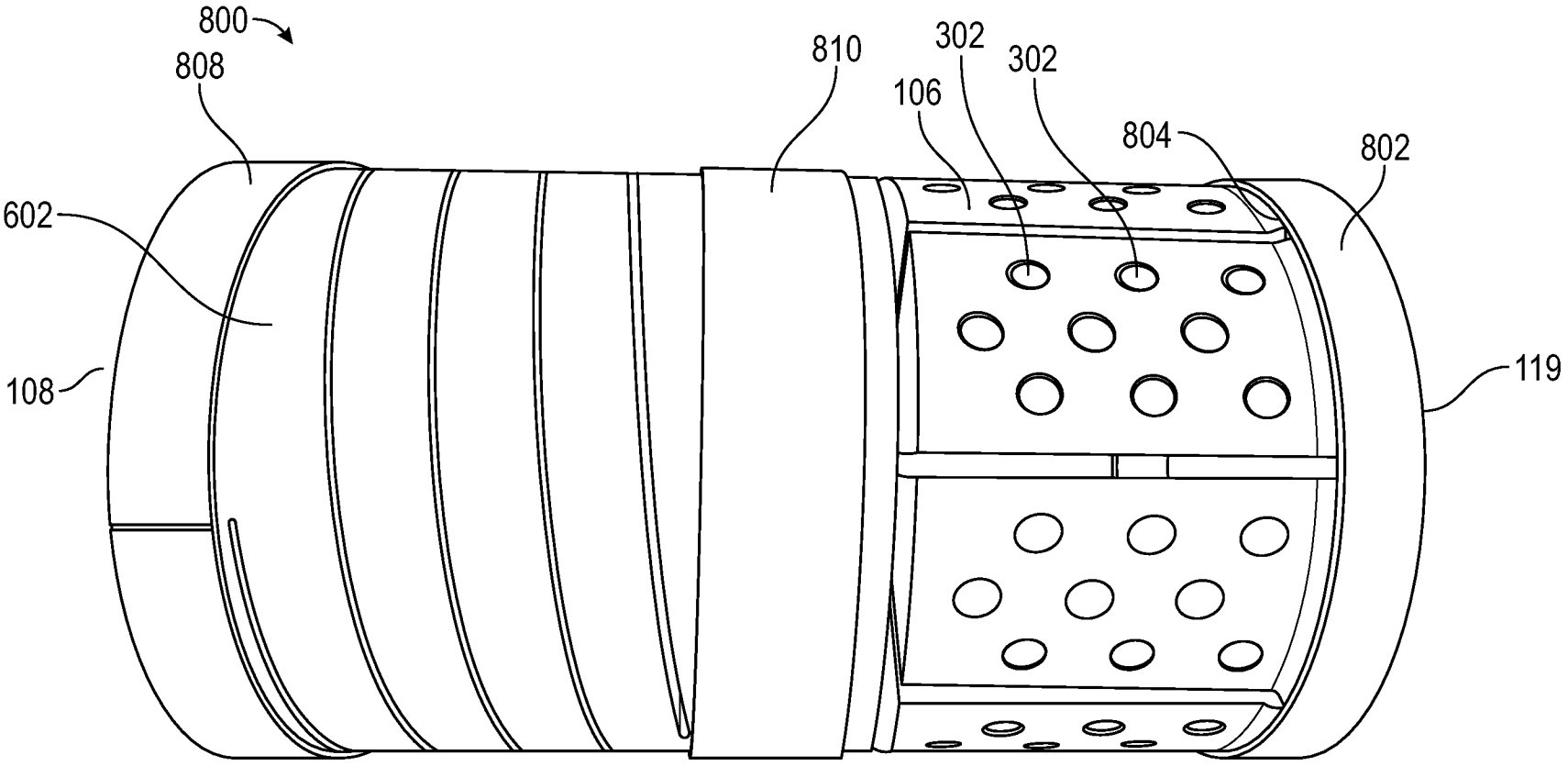
FIG. 8 illustrates a side, perspective view of another downhole tool, according to an embodiment.
Figure 9:
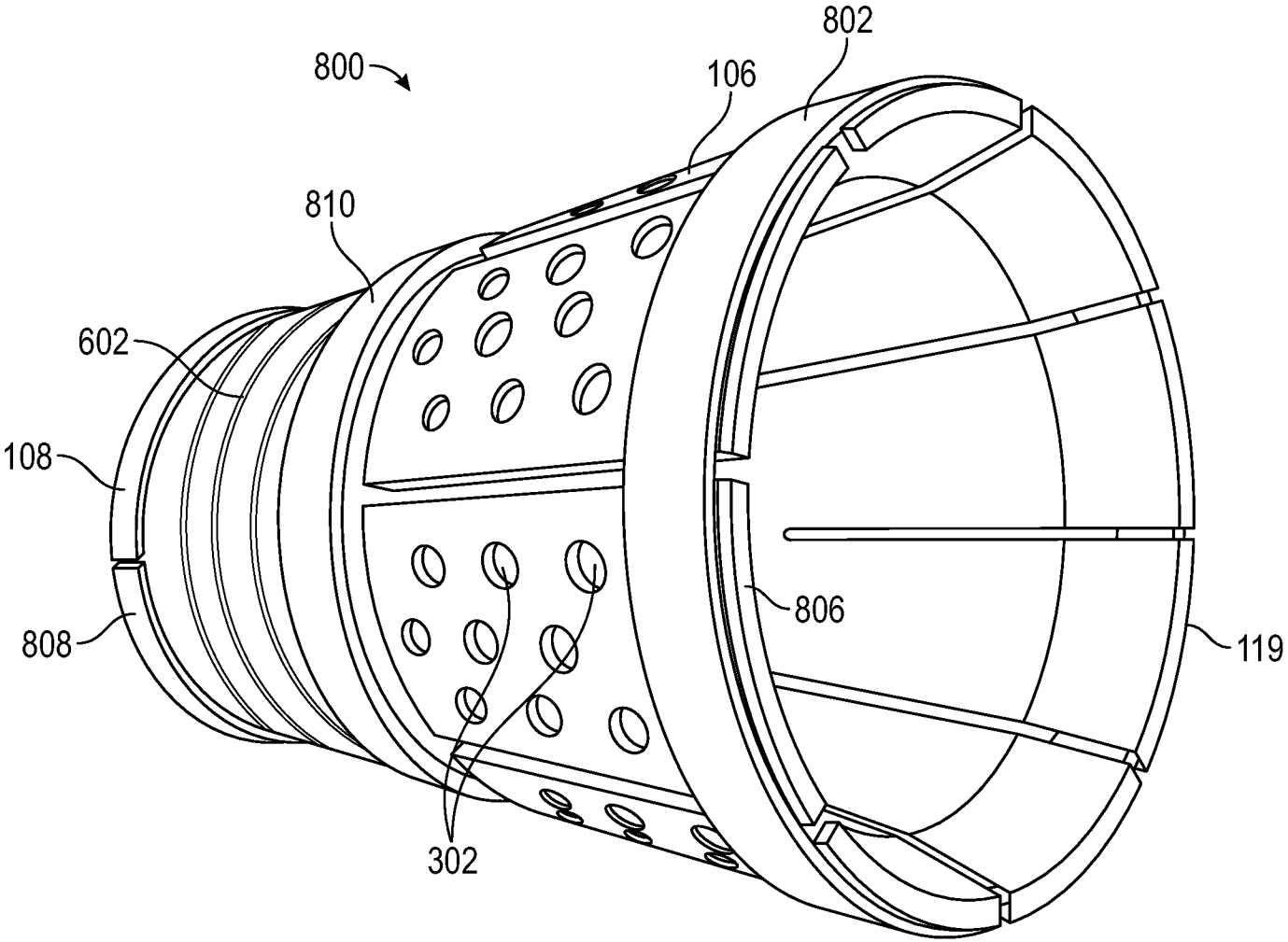
FIG. 9 illustrates a perspective view of the downhole tool of FIG. 8, according to an embodiment.

FIG. 8 illustrates a side, cross-sectional view of another downhole tool 800, according to an embodiment. FIG. 9 illustrates a raised, perspective view of the downhole tool 800, according to an embodiment. Referring to both FIGS. 8 and 9, the downhole tool 800 may be similar to the tool 600, and may include a seal body 602 with one or more grooves 604 cut helically therein. Also like the downhole tool 600, the downhole tool 800 may also include the slip assembly 106, defining the lower end 119. As an addition to the tool 600, the tool 800 may include a retaining member 802, which may include an (e.g., metal) annular ring or band, received around the slip assembly 106 and, e.g., into a circumferentially-extending, positioning groove (not visible) formed proximal to the lower end 119. The retaining member 802 may be crimped or otherwise reduced in diameter to fit securely into the retaining member 802. The retaining member 802 may alternatively be expanded or otherwise increased in inner diameter to fit over the lower end 119 of the slip assembly 106 and then may return to its smaller size to fit securely into the positioning groove. Various other ways to secure the retaining member 802 in the positioning groove will be apparent to one of skill in the art and may be employed without limitation. Finally, the retaining member 802 may be formed from a dissolvable material, such as magnesium.

The slip assembly 106 may define shoulders 804, 806 on either side of the positioning groove (shoulder 804 is best seen in FIG. 8, and shoulder 806 is best seen in FIG. 9). The shoulder 806 may be formed between the positioning groove and the lower end 119. The shoulders 804, 806 may have a smaller outer diameter than the retaining member 802, but larger than at least a portion of the remainder of the slip assembly 106. In other embodiments, the shoulders 804, 806 may not extend outwards from the remainder of the slip assembly 106, but may simply define axial ends of the positioning groove. The positioning groove may be configured to retain an axial position of the retaining member 802 during run-in.

The retaining member 802 may have a greater outer diameter than the slip assembly 106, and, in particular, may extend outwards of the inserts 302 thereof. As such, the retaining member 802 may serve to protect the inserts 302, and any other part of the tool 800, from abrasion during run in. Further, the retaining member 802 may be coated in an abrasion-resistant material, which may include a grit material. In a specific example, the grit material may be applied as a grit coating, such as with a thermal-spray metal. WEARSOX®, which is commercially-available from Innovex Downhole Solutions, Inc., is one example of such a thermal-spray, grit-coating material. Further, the downhole tool 800 may include a second abrasion-resistant ring 808 at the first (upper) end 108 of the seal body 602, and a third abrasion-resistant ring 810 at the transition between the seal body 602 and the slip assembly 106. The second and third abrasion-resistant rings 808, 810 may be solely a grit coating applied to the seal body 602 and/or slips assembly 106, e.g., may not include a ring or band, but in other embodiments, may include such a ring or band.

As with the tool 600, the tool 800 may receive upper and lower cones therein, which may be forced together to increase an outer diameter of the seal body 602 and the slip assembly 106. As this occurs, the retaining member 802 may rupture, thereby freeing the lower end 119 of the slip assembly 106 and allowing the slip assembly 106 to move outward, e.g., into engagement with the surrounding tubular.

Figure 10A:
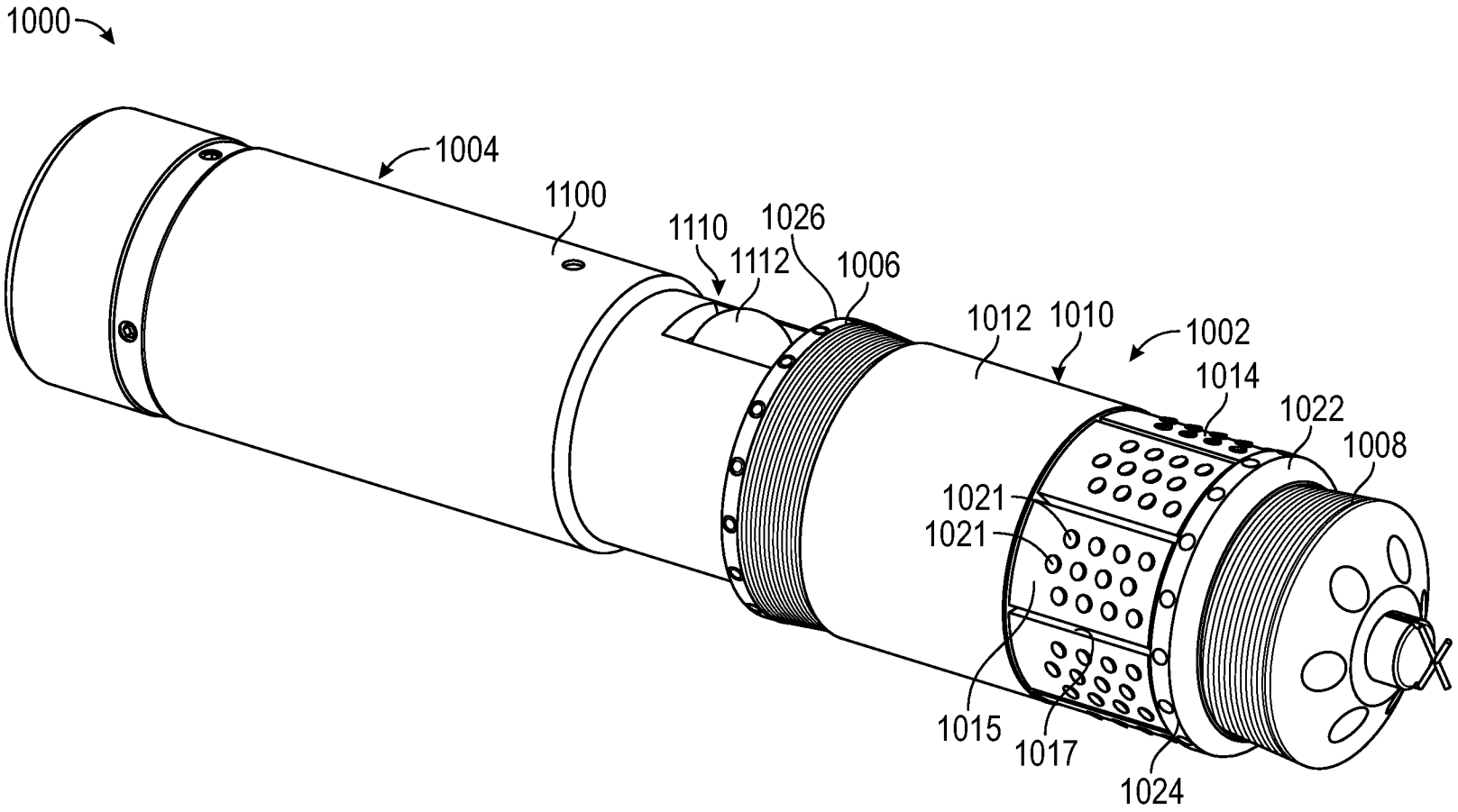
FIG. 10A illustrates a perspective view of a downhole assembly, according to an embodiment.

FIG. 10A illustrates a perspective view of a downhole assembly 1000, according to an embodiment. The downhole assembly 1000 generally include a downhole tool 1002, such as a frac plug, diverter or the like, and a setting tool 1004. The setting tool 1004 may be configured to actuate the downhole tool 1002 from a run-in configuration (illustrated) to a set configuration, as will be described in greater detail below. The setting tool 1004 may be configured for use with any of the downhole tools disclosed herein, or others that may be deformed or otherwise driven radially outward to set in a well.

The downhole tool 1002 may include an upper cone 1006 and a lower cone 1008, which may be positioned at, and at least partially in, opposite axial ends of a main body 1010. The upper cone 1006 and the lower cone 1008 may both be tapered outward, such that advancing the upper cone 1006 and the lower cone 1008 into the main body 1010, toward one another ("adducting" the cones 1006, 1008) may progressively drive the portions of the main body 1010 that come into contact with either of the cones 1006, 1008 radially outwards. Such adducting may be caused by the operation of the setting tool 1004.

The main body 1010 may include a sleeve 1012 and a slips assembly 1014, with the slips assembly 1014 forming the lower portion of the main body 1010 and the sleeve 1012 forming the upper portion, in an embodiment. The sleeve 1012 and the slips assembly 1014 may be integrally formed or made from two pieces that are connected together. In the latter option, the materials used to make the sleeve 1012 and the slips assembly 1014 may be different. For example, the slips assembly 1014 and the sleeve 1012 may be made from different magnesium alloys, such that the slips assembly 1014 and the sleeve 1012 may dissolve or otherwise degrade in the well fluids at different rates.

The slips assembly 1014 may include a plurality of slips 1015, which may be generally arcuate members that are attached to one another in a circumferentially-adjacent fashion such that the slips assembly 1014 extends around a central longitudinal axis. Axially-extending slots 1017 may be formed between adjacent slips 1015. The slots 1017 may extend entirely radially through the thickness of the slips assembly 1014, but in other embodiments, may be grooves that do not extend entirely through the slips assembly 1014, but provide a preferential fracture point. Further, the slots 1017 may extend axially across the entirety of the slips assembly 1014, or may extend only partially across the slips assembly 1014. When the setting tool 1004 advances the lower cone 1008 into the slips assembly 1014, the slips 1015 may spread apart and move radially outwards, e.g., such that buttons 1021 in the slips 1015 may bite into a surrounding tubular and anchor the downhole tool 1002 in the well. The buttons 1021 may be inserts that are at least partially embedded into the slips 1015 and may be shaped and positioned such that a cutting edge extends outward. The buttons 1021 may be harder than the remainder of the slips 1015, e.g., made from a carbide, ceramic, or the like.

The downhole tool 1002 may also include a wear band 1022, which may be positioned at a lower end of the main body 1010. The wear band 1022 may extend to a position that is radially outward of the main body 1010 and radially outward of the lower cone 1006. The wear band may include buttons 1024 at least partially embedded therein. The buttons 1024 may be made from a material that is harder than the main body 1010 and/or the wear band 1022, e.g., a carbide, ceramic, or the like. Further, the buttons 1024 may extend radially outward from the wear band 1022. As such, the buttons 1024 may provide the outer-most surface for the lower end of the downhole tool, thus presenting an abrasion-resistant surface for incidental engagement with the surrounding tubular during run-in. Unlike the buttons 1021, the buttons 1024 may not be configured to bite into the surrounding tubular, and thus may not have a cutting edge, but maybe flat or beveled.

Similarly, the upper cone 1006 may include relatively hard (in comparison to the remainder of the cone 1006) inserts or buttons 1026 embedded therein, which may be made from a carbide, ceramic, or the like. The buttons 1026 may extend outward from the radially outermost region of the upper cone 1006, and to a point that is radially outward of the sleeve 1012. Thus, the buttons 1026 may present an abrasion-resistant surface for incidental engagement with the surrounding tubular during run-in. The buttons 1026 may also lack a cutting edge.

As will be described in greater detail below, the setting tool 1004 may include a setting sleeve 1100, having a window 1110 formed therein. The window 1110 may extend axially from the lower end of the sleeve 1100. An obstructing member 1112 may be entrained in the window 1110, and may be freed from the setting tool 1004 after the setting tool 1004 sets the downhole tool 1002.

Figure 10B:
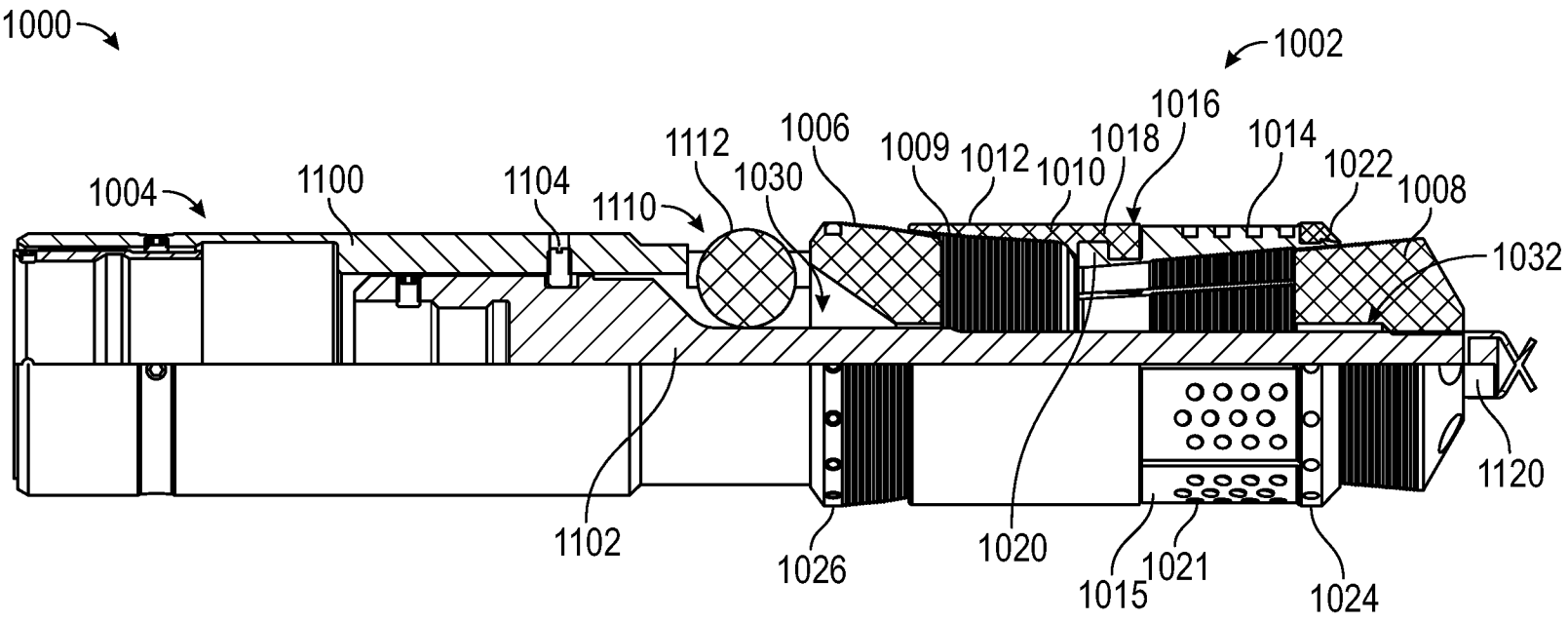
FIG. 10B illustrates a side, half-sectional view of the downhole assembly of FIG. 10A, according to an embodiment.

FIG. 10B illustrates a side, half-sectional view of the downhole assembly 1000, according to an embodiment. The sleeve 1012 and the slips assembly 1014 may be connected together via a connection member 1016. The connection member 1016 may be integral to either or both of the sleeve 1012 and/or the slips assembly 1014. In at least one embodiment, as shown, the connection member 1016 may be formed from as a pair of interlocking extensions 1018, 1020 that are integral with the sleeve 1012 and the slips assembly 1014, respectively. In at least some embodiments, the slips assembly 1014 and the sleeve 1012 (and the extensions 1018, 1020 that are integral therewith) may be made from different materials, e.g., different magnesium alloys configured to dissolve or otherwise degrade at different rates and/or under different conditions in the wellbore. During setting, at least one of the interlocking extensions 1018, 1020 (e.g., extension 1020) may be configured to break, allowing the slips of the slips assembly 1014 to move apart and radially outwards into engagement with the surrounding tubular.

The cones 1006, 1008 may be tapered radially outward as proceeding axially away from one another, and sized such that adducting the cones 1006, 1008 together within the main body 1010 causes the main body 1010 to be deformed radially outward. In particular, moving the upper cone 1006 toward the lower cone 1008 may cause the sleeve 1012 to be deformed radially outward, e.g., to form a seal with the surrounding tubular. Moving the lower cone 1008 toward the upper cone 1006 may cause the slips 1015 of the slips assembly 1014 to break apart, and break apart the connection member 1016, so as to move circumferentially apart from one another and radially outward, into engagement with the surrounding tubular.

The setting tool 1004 is configured to move the upper and lower cones 1006, 1008 together when the downhole tool 1002 arrives at a desired location within the well. In addition to the setting sleeve 1100, the setting tool 1004 may include a setting rod 1102. The setting rod 1102 may extend through a through-bore 1009 that extends axially (i.e., generally parallel to the central axis) in the main body 1010 and through central bores 1030, 1032 formed in the upper and lower cones 1006, 1008, respectively. The setting rod 1102 may engage the lower cone 1008 releasably, such that the setting rod 1102 is configured to apply a predetermined maximum axial force on the lower cone 1008, before shearing or otherwise releasing from the lower cone 1008. Various sheer rings, shear pins, shear teeth, detents, etc. may be employed to provide such releasable connection. In the illustrated embodiment, a nut 1120 is provided to connect the setting rod 1102 to the lower cone 1008 until reaching the predetermined setting force.

The setting sleeve 1100 may apply a downward axial force (e.g., bear directly against) the upper cone 1006, so as to press downward thereon while the setting rod 1102 pulls upward on the lower cone 1008. In some embodiments, a load collar could be interposed between the setting sleeve 1100 and the upper cone 1006 without departing from the scope of the present disclosure.

The setting rod 1102 may be received at least partially within the setting sleeve 1100. For example, the setting rod 1102 may be releasably connected to the setting sleeve 1100, e.g., using one or more shearable members 1104. Until yielded, the shearable members 1104 may prevent relative axial movement of the setting rod 1102 and the setting sleeve 1100, thereby preventing premature setting of the downhole tool 1002.

Figure 11:
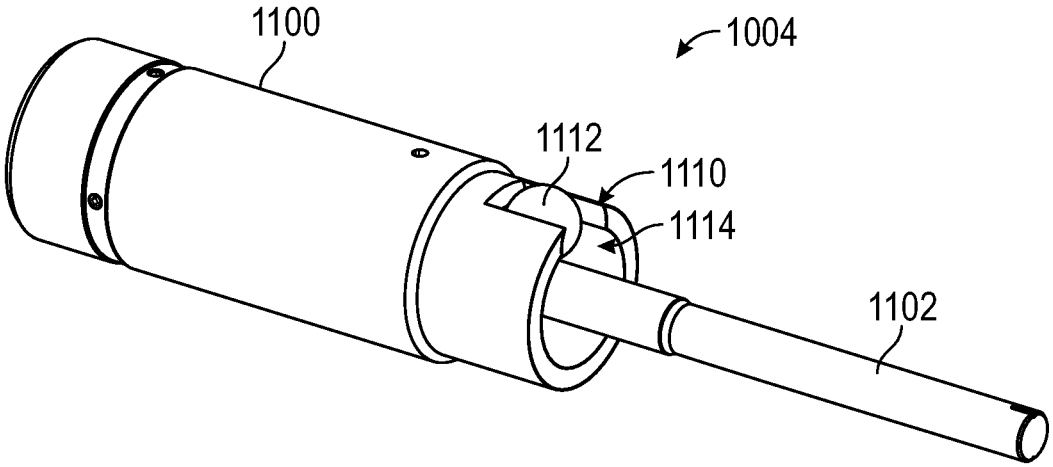
FIG. 11 illustrates a perspective view of a setting tool and obstruction member of the assembly of FIG. 10A, according to an embodiment.

Referring now additionally to FIG. 11, there is shown a perspective view of the setting tool 1004, according to an embodiment. The setting sleeve 1100 may define the window 1110 that extends radially through the wall of the setting sleeve 1100, as shown. The window 1110 may be sized to contain an obstructing member 1112 (e.g., a spherical ball). The circumferential width of the window 1110 may be smaller than the maximum cross-sectional dimension (e.g., diameter) of the obstructing member 1112, such that the obstructing member 1112 is able to stick out through the window 1110, but may not exit from within the setting sleeve 1100 radially outward. Thus, the obstructing member 1112 may be entrained in the window 1110, at least partially between the setting sleeve 1100 and the setting rod 1102, as shown.

Figure 12:
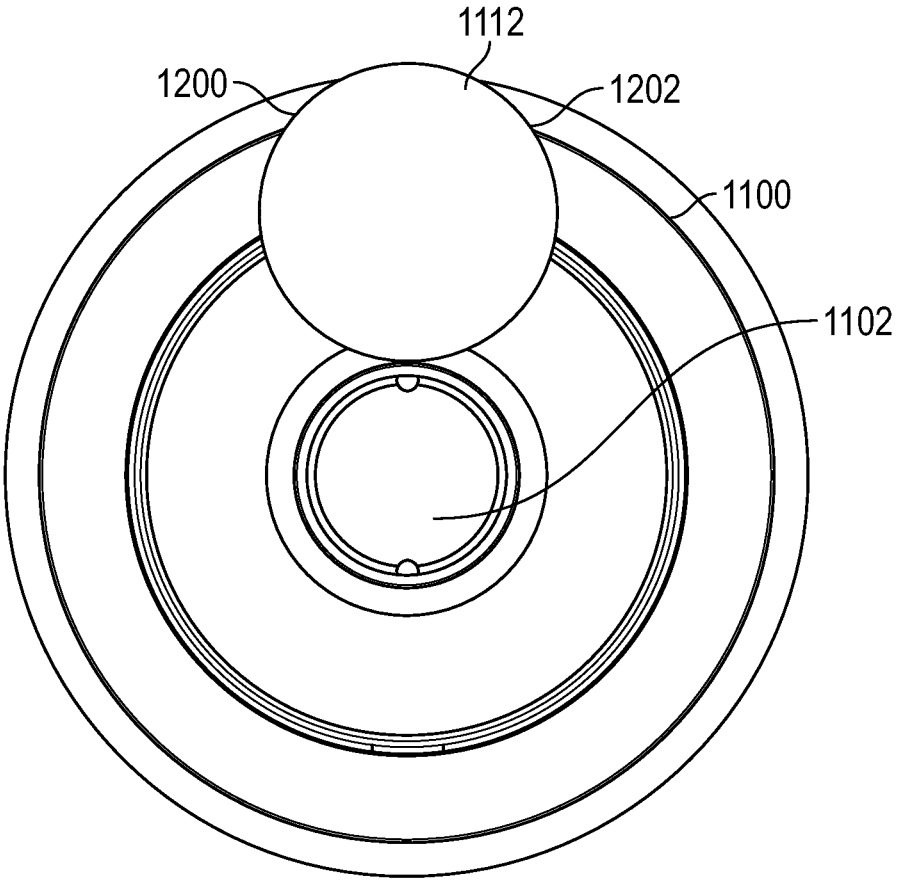
FIG. 12 illustrates an end view of the setting tool and obstruction member of the assembly of FIG. 10A, according to an embodiment.

FIG. 12 shows an axial end view of the setting tool 1004, according to an embodiment. In particular, this view illustrates the relationship between the obstructing member 1112 and the setting sleeve 1100 and the setting rod 1102. The circumferential edges 1200, 1202 of the window 1110 may be curved, so as to conform to the shape of the obstructing member 1112. Further, the setting rod 1102 may prevent dislocation of the obstructing member 1112 radially inward, and thus the obstructing member 1112 may remain pinned partially between the setting sleeve 1100 and the setting rod 1102, with the radially-outer extent of the obstructing member 1112 extending outward from the setting sleeve 1100. This arrangement allows for a relatively large obstructing member 1112 to be employed, and run into the well along with the downhole tool 1002, which allows for a larger central bore 1030 in the upper cone 1006, since the obstructing member 1112 is called upon to, at least temporarily, plug the central bore 1030.

Referring again to FIG. 11, a lower end 1114 of the window 1110 may be open, however, such that the obstructing member 1112 may exit the window 1110 in an axial direction, through the lower end 1114 when the lower end 1114 is spaced apart from the upper cone 1006. This is the case when the setting tool 1002 has set the downhole tool 1002 and is removed uphole. Once freed to exit the window 1110, the obstructing member 1112 may fall into the valve seat defined by the central bore 1030 of the upper cone 1006, thereby blocking the through bore 1009 and at least substantially preventing fluid flow past the downhole tool 1002 (FIG. 10B).

Figure 13:
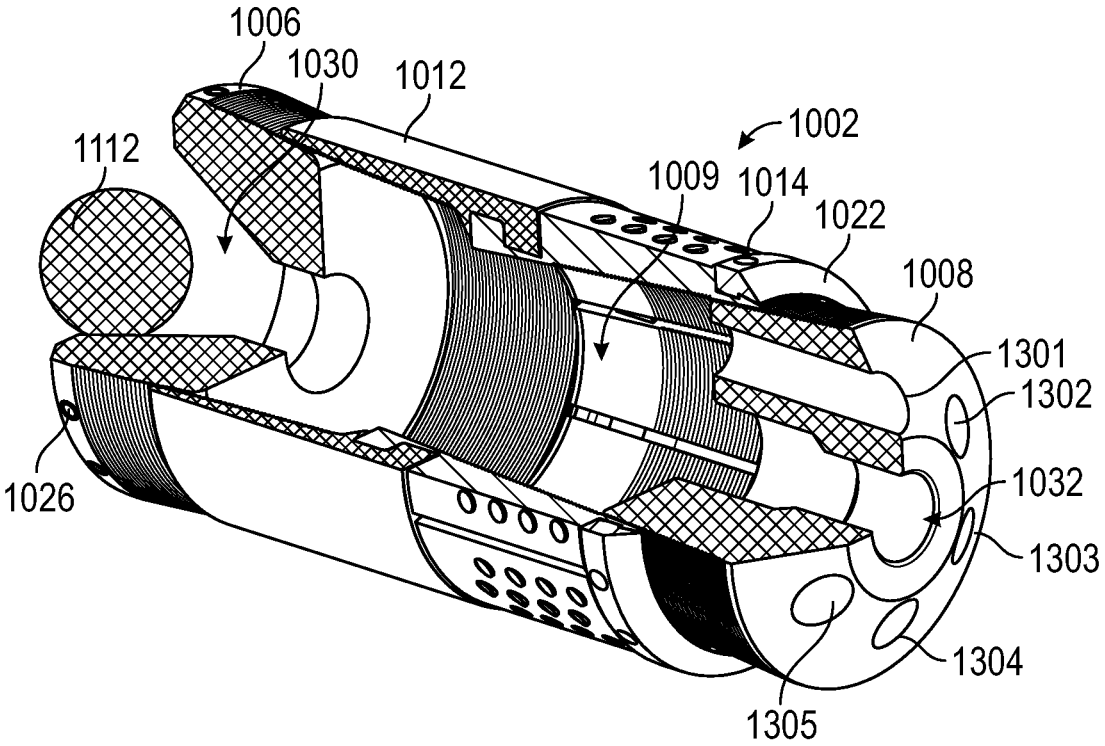
FIG. 13 illustrates a quarter-sectional, perspective view of a downhole tool of the assembly of FIG. 10A, according to an embodiment.

FIG. 13 illustrates a quarter-sectional, perspective view of the downhole tool 1002 in the run-in configuration, i.e., before the cones 1006, 1008 have been adducted together by the setting tool 1004, according to an embodiment. In this view, the setting tool 1004 is omitted for purposes of clarity. The lower cone 1008 may include one or more secondary bores (five shown: 1301, 1302, 1303, 1304, 1305) positioned radially outward from the central bore 1032. The secondary bores 1301-1005 may not receive the setting rod 1102 therethrough, but may be distributed at generally uniform angular intervals. The provision of the secondary bores 1301-1305 may serve to increase the flowrate of fluid through the through-bore 1009, as well as provide additional surface area for contact between the fluid and the lower cone 1008. Such increased surface area may reduce the amount of time taken for the lower cone 1008 to dissolve or otherwise degrade in the wellbore fluids.

Further, as can also be seen in FIG. 13, the obstructing member 1112 is configured to be caught in the bore 1030 of the upper cone 1006, so as to plug the through-bore 1009 and block fluid flow axially through the downhole tool 1002.

Figure 14:
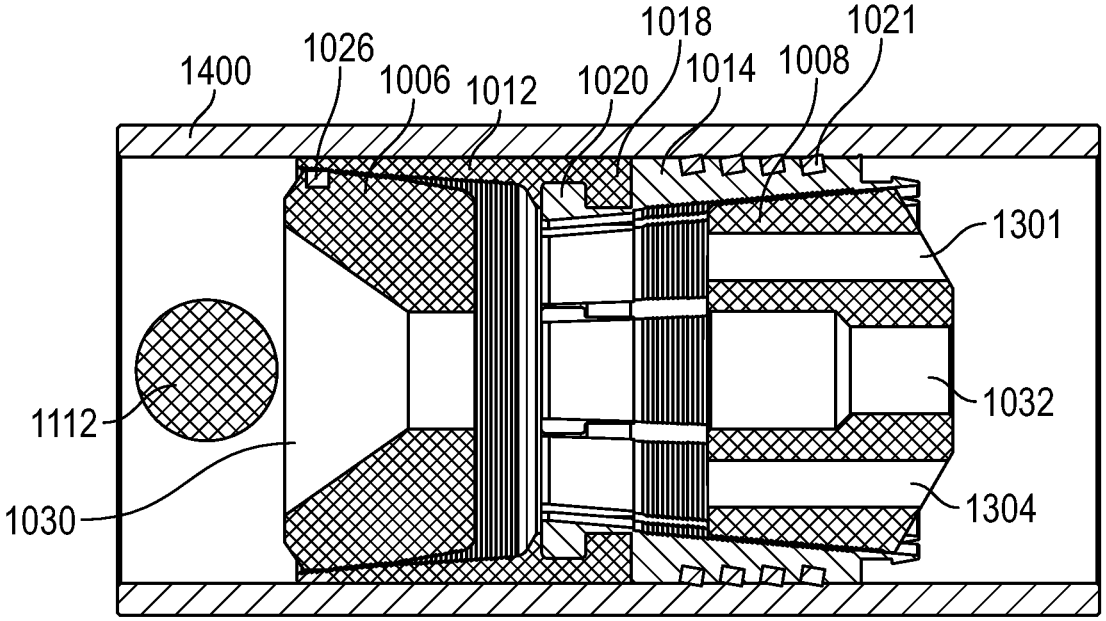
FIG. 14 illustrates a side, cross-sectional view of the downhole tool of the assembly of FIG. 10A, according to an embodiment.

FIG. 14 illustrates a side, cross-sectional view of the downhole tool 1002 in a set configuration, i.e., after the setting assembly 1004 has adducted the upper and lower cones 1006, 1008 together, according to an embodiment. It will be appreciated that this may not be the final configuration of the downhole tool 1002, as, for example, the obstructing member 1112 landing on the upper cone 1006, and pressuring up the well above the downhole tool 1002, may cause the upper cone 1006 to be driven further into the sleeve 1012.

As shown, the downhole tool 1002 is anchored in place within a surrounding tubular (e.g., casing) 1400 by the sleeve 1012 and the slips 1014. In particular, adduction of the upper and lower cones 1006, 1008 has driven the sleeve 1012 and the slips assembly 1014 radially outward. Accordingly, the inserts 1021 of the slips assembly 1014, which are positioned at an angle such that a cutting edge extend outward therefrom, bite into the surrounding tubular 1400. Further, to allow for such movement outwards by the slips assembly 1014, the extension 1020 forming part of the connecting member 1016 has fractured, thereby allowing the slips assembly 1014 to move relative to the sleeve 1012.

Additionally, the wear band 1022, which was present in the run-in configuration (e.g., FIG. 13), is not present in the set configuration of FIG. 14. The wear band 1022 may be configured to fracture during the setting process, as it may constrain the radial outward movement of the slips assembly 1014. Thus, when the lower cone 1008 moves in an upward direction, toward the upper cone 1006, the lower cone 1008 may force the slips assembly 1014 radially outward, fracturing the wear band 1022, which may then fall away into the well.

Further, the obstructing member 1112 has been released from the setting tool 1004 and is free to move, under fluid pressure, into engagement with and at least partially seal with the valve seat formed by the bore 1030 of the upper cone 1006.

Figure 15:
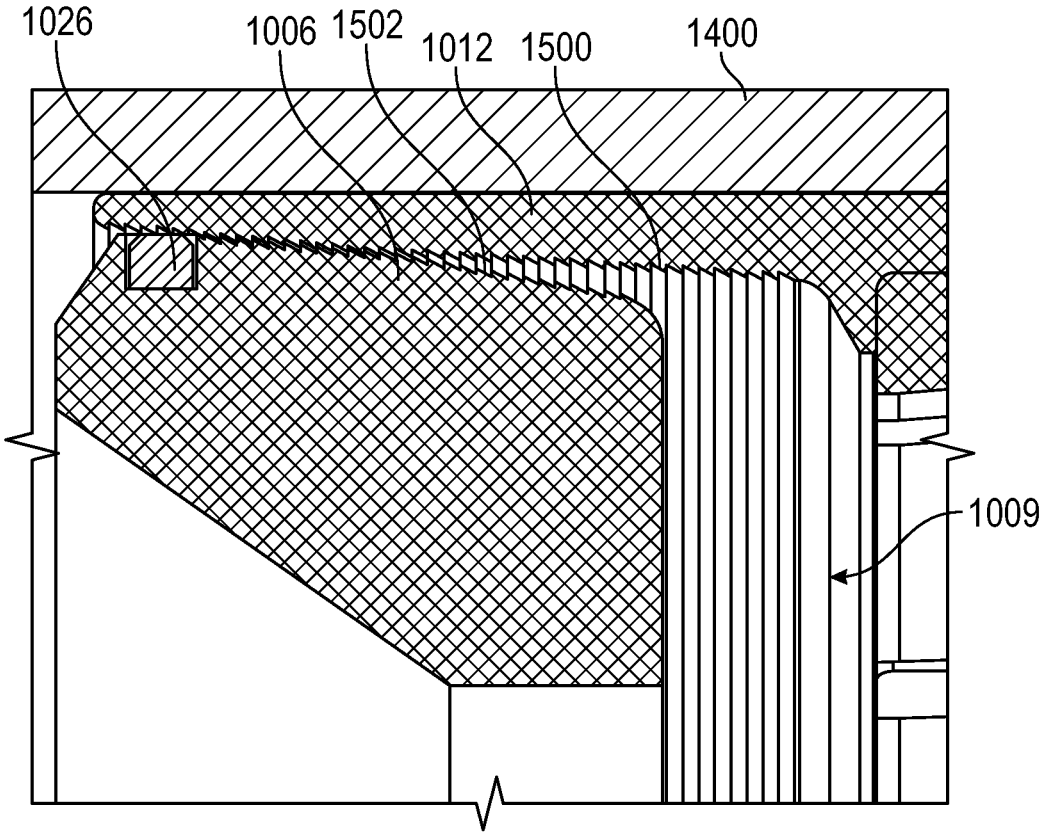
FIG. 15 illustrates an enlarged view of a portion of FIG. 14, according to an embodiment.

FIG. 15 illustrates an enlarged view of a portion of FIG. 14, showing part of the upper cone 1006, the sleeve 1012, and the surrounding tubular 1400, according to an embodiment. As shown, the inside of the sleeve 1012, defining a portion of the through-bore 1009, may include threads 1500, which may be angled. The outside of the upper cone 1006 may include complementary threads 1502. The combination of the threads 1500, 1502 may provide a ratcheting mechanism, which allows the upper cone 1006 to be advanced into the through-bore 1009, but prevents the upper cone 1006 from backing out of the through bore 1009. Thus, the threaded engagement may prevent the downhole tool 1002 from releasing out of the set configuration, once set in the well.

Further, the buttons 1026 on the upper end of the upper cone 1008 are oriented to avoid having a cutting edge extending outwards therefrom. In this embodiment, this may contrast with the buttons 1021 on the slips assembly 1014, which may be oriented to have such a cutting edge, as the buttons 1021 on the slips assembly 1014 are configured to bite into the surrounding tubular 1400. As mentioned above, the buttons 1026 are configured to provide an abrasion-resistant sliding surface for the upper cone 1006. To avoid damaging the inside surface of the sleeve 1012, the buttons 1026 may be beveled, rounded, or otherwise flattened.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a sleeve having a first end and a second end;

a slip assembly coupled to the second end of the sleeve;

a first cone positioned at least partially in the sleeve, proximal to the first end thereof; and a second cone positioned at least partially in the slip assembly, wherein the first and second cones are configured to be moved toward one another from a run-in configuration to a set configuration, wherein, when actuating from the run-in configuration to the set configuration, the sleeve is forced radially outward by the first cone, wherein, when actuating from the run-in configuration to the set configuration, the slip assembly is forced radially outward by the second cone, and wherein, when the second cone is moved toward the set configuration, the second cone forces the slip assembly axially toward the second end of the sleeve.

2. The downhole tool of claim 1, wherein the slip assembly comprises a plurality of slip segments disposed circumferentially adjacent to one another, and wherein, when the second cone is moved toward the set configuration, the second cone separates the plurality of slip segments circumferentially apart from one another.

3. The downhole tool of claim 1, wherein the first cone forces the sleeve radially outwards from the run-in configuration to the set configuration, and wherein the sleeve in the set configuration forms at least a partial seal with a surrounding tubular.

4. The downhole tool of claim 1, wherein the slip assembly comprises a plurality of inserts configured to be at least partially embedded into a surrounding tubular when the downhole tool is in the set configuration.

5. The downhole tool of claim 1, wherein the slip assembly comprises a grit coating on an outside surface thereof, the grit coating configured to engage a surrounding tubular when the downhole tool is in the set configuration.

6. The downhole tool of claim 1, wherein the sleeve is made from a first material, and the slip assembly is made from a second material, the first and second materials being configured to dissolve at different rates in a well.

7. The downhole tool of claim 1, further comprising a connection member extending between and connecting together the second end of the sleeve and the slip assembly, wherein the connection member is configured to break apart when the downhole tool is moved into the set configuration.

8. The downhole tool of claim 1, further comprising a retaining member extending around the slip assembly, wherein the retaining member is configured to break apart when the downhole tool is actuated into the set configuration.

9. The downhole tool of claim 8, wherein the retaining member comprises a grit coating on an outside surface thereof.

10. The downhole tool of claim 1, wherein the first cone comprises one or more inserts at least partially embedded therein and extending outwards therefrom so as to provide a wear surface for engaging a surrounding tubular when running the downhole tool into a well.

11. The downhole tool of claim 10, wherein the one or more inserts of the first cone lack a cutting edge, such that the one or more inserts are configured to avoid damaging an inside surface of the sleeve during setting when the first cone, including the one or more inserts, moves fully into the sleeve.

12. The downhole tool of claim 1, wherein the second cone defines a plurality of bores extending therethrough.

13. A downhole tool, comprising:

a sleeve having a first end and a second end;

a slip assembly coupled to the second end of the sleeve;

a first cone positioned at least partially in the sleeve, proximal to the first end thereof; and a second cone positioned at least partially in the slip assembly, wherein the first and second cones are configured to be moved toward one another from a run-in configuration to a set configuration;

a connection member extending between and connecting together the second end of the sleeve and the slip assembly, wherein the connection member is configured to break apart when the downhole tool is moved into the set configuration, wherein, when actuating from the run-in configuration to the set configuration, the sleeve is forced radially outward by the first cone, wherein, when actuating from the run-in configuration to the set configuration, the slip assembly is forced radially outward by the second cone, wherein the connection member at least partially defines a gap between the second end of the sleeve and the slip assembly, and wherein, the slip assembly moves axially toward the second end of the sleeve when the downhole tool is in the set configuration thereby substantially closing the gap.

14. A downhole tool, comprising:

a sleeve having a first end and a second end;

a slip assembly coupled to the second end of the sleeve;

a first cone positioned at least partially in the sleeve, proximal to the first end thereof; and a second cone positioned at least partially in the slip assembly, wherein the first and second cones are configured to be moved toward one another from a run-in configuration to a set configuration, wherein, when actuating from the run-in configuration to the set configuration, the sleeve is forced radially outward by the first cone, wherein, when actuating from the run-in configuration to the set configuration, the slip assembly is forced radially outward by the second cone, and wherein the slip assembly is configured to pivot toward the sleeve when the first and second cones are moved to the set configuration.

15. A downhole tool, comprising:

a sleeve having a first end and a second end;

a slip assembly coupled to the second end of the sleeve;

a first cone positioned at least partially in the sleeve, proximal to the first end thereof; and a second cone positioned at least partially in the slip assembly, wherein the first and second cones are configured to be moved toward one another from a run-in configuration to a set configuration, wherein, when actuating from the run-in configuration to the set configuration, the sleeve is forced radially outward by the first cone, wherein, when actuating from the run-in configuration to the set configuration, the slip assembly is forced radially outward by the second cone, and wherein the downhole tool further comprising a retaining member extending around the slip assembly, wherein the retaining member is configured to break apart when the downhole tool is actuated into the set configuration, wherein the retaining member comprises one or more inserts at least partially embedded therein and extending outwards therefrom so as to provide a wear surface for engaging a surrounding tubular when running the downhole tool into a well.

16. A downhole assembly, comprising:

a downhole tool comprising:

a sleeve having a first end and a second end;

a slip assembly coupled to the second end of the sleeve;

a first cone positioned at least partially in the sleeve, proximal to the first end thereof, the first cone defining a valve seat; and a second cone positioned at least partially in the slip assembly, wherein the first and second cones are configured to be moved toward one another from a run-in configuration to a set configuration, wherein, when actuating from the run-in configuration to the set configuration, the sleeve is forced radially outward by the first cone, and wherein, when actuating from the run-in configuration to the set configuration, the slip assembly is forced radially outward by the second cone;

a setting tool comprising:

a setting sleeve configured to apply a force on the first cone, to move the first cone toward the second cone; and a setting rod extending in the setting sleeve, through the first cone, and releasably coupled with the second cone, the setting rod being configured to apply a force on the second cone to move the second cone toward the first cone; and an obstructing member configured to engage the valve seat of the first cone, so as to block fluid flow through the downhole tool, when the downhole tool is in the set configuration.

17. The assembly of claim 16, wherein the obstructing member is entrained at least partially between the setting rod and the setting sleeve, until the setting tool is released from the downhole tool.

18. The assembly of claim 17, wherein the obstructing member is further entrained between the setting sleeve and the first cone, until the setting tool is released from the downhole tool.

19. The assembly of claim 17, wherein the slip assembly and the sleeve are coupled together and are made from different materials.

* * * * *